United States Patent [19]

Springmann

[11] 4,211,544

[45] Jul. 8, 1980

[54] COMPRESSION OF NITROGEN OVERHEAD FROM HIGH PRESSURE COLUMN IN TRACTIONATION OF AIR

[75] Inventor: Helmut Springmann, Geretsried, Fed. Rep. of Germany

[73] Assignee: Linde Aktiengesellschaft, Wiesbaden, Fed. Rep. of Germany

[21] Appl. No.: 897,073

[22] Filed: Apr. 17, 1978

[30] Foreign Application Priority Data

Apr. 19, 1977 [DE] Fed. Rep. of Germany ..... 2717107

[51] Int. Cl.[2] ..... F25J 3/04

[52] U.S. Cl. ..... 62/30; 62/41; 62/38; 62/40

[58] Field of Search ..... 62/29, 30

[56] References Cited

U.S. PATENT DOCUMENTS

| | | | |
|---|---|---|---|
| 2,627,731 | 2/1953 | Benedict | 62/30 |
| 2,685,181 | 8/1954 | Schlitt | 62/30 |
| 3,173,778 | 3/1965 | Gaumer, Jr. | 62/29 |
| 3,251,190 | 5/1966 | Seidel | 62/30 |

*Primary Examiner*—Norman Yudkoff
*Attorney, Agent, or Firm*—Millen & White

[57] ABSTRACT

In a process for the low-temperature fractionation of air by two-stage rectification wherein nitrogen is withdrawn in the gaseous phase from the upper portion of the high-pressure column, warmed, compressed, cooled, liquefied, and recycled into the upper portion of the high-pressure column, the improvement which comprises conducting the liquefying of the nitrogen in heat exchange with evaporating oxygen in the lower portion of the low-pressure column. This process is particularly amenable to the use of LNG as refrigerant where LNG must be vaporized.

7 Claims, 1 Drawing Figure

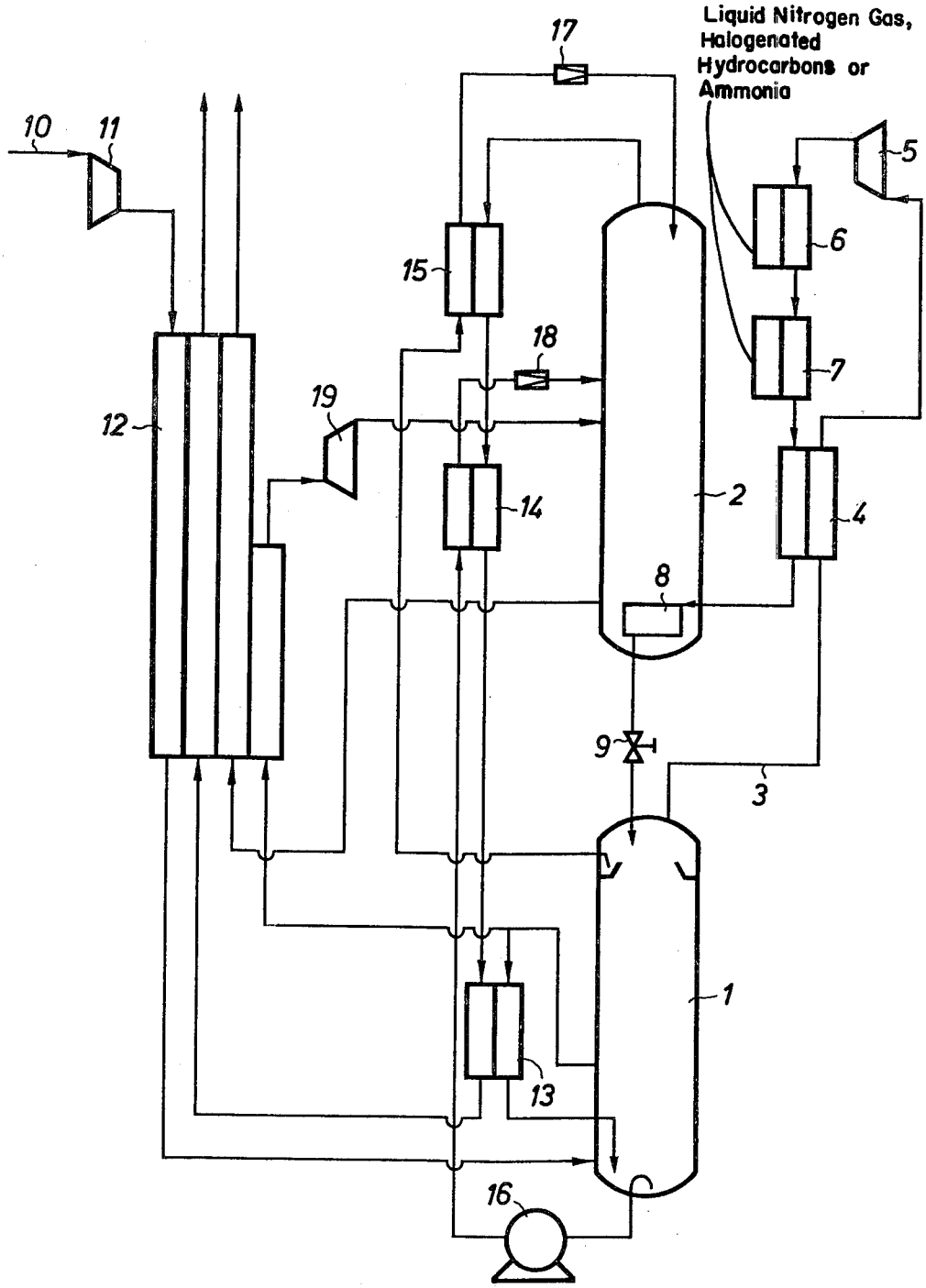
Liquid Nitrogen Gas,
Halogenated
Hydrocarbons or
Ammonia
17
10
11
5
6
15
18
7
19
12
14
2
4
8
9
3
1
13
16

COMPRESSION OF NITROGEN OVERHEAD FROM HIGH PRESSURE COLUMN IN TRACTIONATION OF AIR

BACKGROUND OF THE INVENTION

This invention relates to a system for the low-temperature fractionation of air by two-stage rectification in a high-pressure column and a low-pressure column wherein nitrogen is withdrawn in the gaseous phase from the upper part of the high-pressure column, warmed, compressed, cooled, liquefied, and then recycled into the upper part of the high-pressure column.

A process for air fractionation is known from British Pat. No. 975,729 wherein gaseous nitrogen is evolved in the high-pressure column of a two-stage rectification unit. This gaseous nitrogen is compressed at a temperature of below −50° C., cooled by indirect heat exchange with an external refrigerant, and then recycled via a pressure reducing valve into the high-pressure column.

This conventional process is employed if a large quantity of a liquid external refrigerant is readily available, and it is desired that this external liquid refrigerant be converted into the gaseous phase. As compared with conventional air fractionation processes, the steps of compression of the gaseous nitrogen withdrawn from the high-pressure stage and the subsequent cooling of the nitrogen result in a saving in energy. However, a significant disadvantage of this method is the fact that the external refrigerant is utilized merely for the production of liquid nitrogen, rather than also for lowering energy consumption during the fractionation process.

SUMMARY OF THE INVENTION

An object of this invention is to provide a process for air fractionation of the type described hereinabove wherein, as compared with conventional air fractionation processes of this type, a further savings in energy is realized with only a relatively small additional plant investment.

Upon further study of the specification and appended claims, further objects and advantages of this invention will become apparent to those skilled in the art.

To attain these objects, compressed nitrogen is liquefied indirect heat exchange with evaporating oxygen in the lower part of the low-pressure column.

It is conventional in the fractionation of air in a two-stage rectification unit to withdraw liquefied nitrogen from the head of the high-pressure column so it can be passed as reflux to the top of the low-pressure column. Owing to this requirement, the pressure in the high-pressure column is generally fixed at about 2 to 20 atm. absolute in those air fractionation plants which do not provide for a compression and cooling of the nitrogen obtained in the upper part of the high-pressure column. According to the invention, however, as contrasted to the above, the nitrogen obtained in the upper part of the high-pressure stage is compressed in a separate process step and liquefied in the lower part of the low-pressure column in heat exchange with evaporating oxygen. Inasmuch as the high-pressure column can thus be operated under a relatively lower pressure, about 2 to 10, preferably 2 to 6 atm. absolute, there is realized a substantial reduction in the energy costs required for compression of the air feed to the conventional higher pressures. This more than offsets the energy for compression of the withdrawn nitrogen stream to about 6—20 atm. since the volume of withdrawn nitrogen constitutes only about 50–80, preferably 70 to 80% by volume $Nm^3$ of the air feed.

The process of this invention also has the particular advantage over the method of British Pat. No. 975,729 insofar as a cost reduction can additionally be achieved in the air fractionation itself. A further advantage afforded by the process of this invention as compared to the British patent resides in the fact that leakage points in the primary heat exchanger in the lower part of the low-pressure column do not lead to a contamination of the entire rectification plant, as otherwise would be the case with the use of external refrigerants.

As a preferred aspect of this invention, it is advantageous to warm the nitrogen withdrawn from the upper part of the high-pressure column by heat exchange with itself, after it has been compressed. In this way, it is possible to utilize external refrigerants at freely selectable temperature stages. For example, halogenated hydrocarbons
ammonia
liquid natural gas In another preferred aspect of this invention, it is advantageous to expand the nitrogen liquefied in the lower part of the low-pressure column before it is introduced into the upper part of the high-pressure column. The thereby obtained subcooling of the liquefied nitrogen can be utilized for the precooling of the gaseous nitrogen to be withdrawn via conduit 3.

A particularly large saving in energy can be attained by cooling the nitrogen withdrawn at the upper part of the high-pressure column, after its compression, by heat exchange with liquid natural gas which is fed, for example, in an LNG terminal in the liquid phase and which is to be vaporized.

BRIEF DESCRIPTION OF THE DRAWING

The drawing is a schematic flowsheet of the preferred comprehensive embodiment of the invention.

DETAILED DESCRIPTION OF THE DRAWING

The rectification unit is comprised of a high-pressure column 1 and a low-pressure column 2. Air is supplied via a conduit 10, this air being compressed in a compressor 11 and cooled in a heat exchanger 12 before being introduced into the high-pressure stage 1. The heat exchanger 12 can be constructed as a regenerator or a reversing exchanger. To ensure trouble-free operation of the heat exchanger 12, the compressor 11 must compress the incoming air to about 3.5 atmospheres absolute.

The gaseous nitrogen produced in the high-pressure column 1 is withdrawn from the head of the high-pressure column 1 at about 100° K. and, according to the invention, conducted via a conduit 3 through a heat exchanger 4. The thus-warmed nitrogen at about 270° K. is compressed to about 6 atm. absolute in compressor 5, thereby heating the gaseous nitrogen to about 350° K. The compressed nitrogen is then cooled with the aid of coolers 6 and 7 to a temperature of about 260° K. and after heat exchange with itself in heat exchanger 4 to about 100° K., conducted to a condenser 8 located in the lower part of the low-pressure column 2 when the nitrogen is converted to the liquid phase. Via a throttle valve 9, the thus-liquefied nitrogen is finally pressure reduced into the upper part of the high-pressure stage 1 where it functions as reflux. The low-pressure column operates at about 1.5 atm. absolute and at 90° to 95° K. Based on 100 parts by volume of air $Nm^3$ entering conduit 10, about 70 to 80 parts by volume ($Nm^3$) of $N_2$ are removed from the high-pressure column in conduit 3.

The remainder of the process involves conventional steps effected in processes for the low-temperature fractionation of air by two-stage rectification. The following units are employed for this purpose: heat exchangers 13, 14 and 15; an oxygen pump 16; throttle valves 17 and 18; and an expansion turbine 19.

In addition to using the process of this invention in connection with air fractionation plants, it is also possible to employ the present process in coal-oil gasification plants, as well as in plants for the separation of liquid natural gas.

Coal-oil gasification plants:

It can be of interest, especially if the gasification process is used for the combined power cycle to design an air separation unit for higher operating pressure. In this case the medium pressure column should be operated at the same pressure as the low pressure column. Then the top product of the medium pressure column is compressed to the pressure required for condensation in the main condenser. This system enables a better reflux ratio in the medium pressure column.

In natural gas terminals:

Liquid natural gas must be evaporated and fed into the pipeline. The cold of evaporation can be advantageously used for cooling the compressor compressing the top product of the medium pressure column to the condenser pressure in the main condenser. This way decreases considerably the mechanical power requirements for the compression. Then it is possible to reduce the power requirements for producing gaseous nitrogen and oxygen.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the low-temperature fractionation of air by two-stage rectification comprising separate high and low pressure rectification columns, wherein nitrogen is withdrawn in the gaseous phase from the upper portion of the high-pressure column, warmed, compressed, cooled, liquefied, pressure reduced, and recycled as reflux into the upper portion of the high-pressure column, the improvement which comprises withdrawing the gaseous nitrogen from the high pressure column and without heat exchange with the liquid bottoms of the low pressure column, compressing the gaseous nitrogen, and then liquefying the compressed nitrogen in heat exchange with evaporating oxygen in the lower portion of the low-pressure column.

2. A process according to claim 1, further comprising warming the nitrogen withdrawn from the upper portion of the high-pressure column prior to compression in indirect heat exchange with the compressed gaseous nitrogen.

3. A process according to claim 1, wherein the pressure reducing is conducted by passing through a throttle valve the nitrogen liquefied in the lower part of the low-pressure column before it is recycled into the upper part of the high-pressure column.

4. A process according to claim 1, wherein the nitrogen withdrawn from the upper part of the high-pressure column is cooled, after compression, by indirect heat exchange with liquid natural gas.

5. A process according to claim 1 wherein the nitrogen withdrawn from the upper part of the high pressure column is cooled in indirect heat exchange with halogenated hydrocarbons.

6. A process according to claim 1 wherein the nitrogen withdrawn from the upper part of the high pressure column is cooled in indirect heat exchange with ammonia.

7. A process according to claim 3 wherein the high pressure column is operated at about 3.5 atmospheres absolute, the gaseous nitrogen withdrawn from the high pressure column is compressed to about 6 atmospheres, and the low pressure column is operated at about 1.5 atmospheres absolute.

* * * * *